US006260362B1

(12) United States Patent
Choi

(10) Patent No.: US 6,260,362 B1
(45) Date of Patent: Jul. 17, 2001

(54) APPARATUS OPERATED IN RESPONSE TO LOAD IN HOME BAR OF REFRIGERATOR AND METHOD THEREOF

(75) Inventor: Woong Chul Choi, Changwon (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 09/461,812

(22) Filed: Dec. 16, 1999

(30) Foreign Application Priority Data

Dec. 31, 1998 (KR) ..... 98-63605

(51) Int. Cl.[7] ..... F25D 17/06
(52) U.S. Cl. ..... 62/89; 62/186
(58) Field of Search ..... 62/186, 89, 208

(56) References Cited

U.S. PATENT DOCUMENTS 5,791,152 * 8/1998 Choi ..... 62/89
6,055,820 * 5/2000 Jeong et al. ..... 62/186
6,055,823 * 5/2000 Baker et al. ..... 62/441

* cited by examiner

*Primary Examiner*—Michael Powell Buiz
*Assistant Examiner*—Mohammad M Ali

(57) ABSTRACT

An apparatus operated in response to a load in a home bar of a SXS refrigerator having the home bar at one side of its door and a cooling air circulator including: a refrigerating chamber temperature sensor for sensing a temperature change of a refrigerating chamber; a home bar temperature sensor for sensing a temperature change of the home bar; and a microprocessor for comparing a temperature change amount of the home bar sensed by the home bar temperature sensor and the temperature change amount of the refrigerating chamber sensed by the refrigerating chamber temperature sensor after a load is inputted to the home bar, and setting a temperature of the refrigerating chamber at a lower degree in accordance with the comparison result and accordingly driving a cooling air circulator. Accordingly, in case that a load is inputted to the home bar by opening the door of the home bar or the door of the refrigerating chamber, depending on the fact that the temperature of the home bar goes up due to the inputted load and the temperature of the refrigerating chamber goes down with no load inputted, the pre-set target temperature of the refrigerating chamber is reset to be lowered down, so as to cool the load inputted to the home bar promptly, thereby maintaining freshness of the load and serving the convenience of users.

4 Claims, 5 Drawing Sheets

APPARATUS OPERATED IN RESPONSE TO LOAD IN HOME BAR OF REFRIGERATOR AND METHOD THEREOF

BACKGROUND OF THE INVENTION

1. Field of the Invention

The present invention relates to an apparatus for controlling a temperature of a home bar of a refrigerator, and more particularly, to an apparatus operated in response to a load (i.e., beer, cans, etc.) in a home bar of a refrigerator by which a cooling speed is adjusted depending on the amount of a load inputted to the home bar insertedly installed in a door of a refrigerator, thereby cutting down on a time taken for cooling the home bar and maintaining a freshness of the inputted load.

2. Description of the Background Art

Generally, a refrigerator is provided with a cooling air circulator including such as a compressor, a condensor, capillary and evaporator, etc., of which the evaporator absorbs internal heat to maintain a freezing and refrigerating condition so that contents of the refrigerator is kept coolly and freshly.

In order to meet various desires of consumers and as related techniques are being developed, refrigerators are made in various forms, and recently, large-sized refrigerators are gaining much popularity.

FIG. 1 illustrates a refrigerator with its door closed in accordance with a conventional art, and FIG. 2 illustrates a refrigerator with its door opened in accordance with the conventional art.

As shown in the drawings, the conventional refrigerator includes a refrigerator main body 10 consisting of a freezing chamber and a refrigerating chamber at its inner side; a left door 20 and a right door 30 each rotatably installed at both sides of the refrigerator main body 10 so as to open and close the main body; a home bar 31 insertedly intstalled at either side of the left and right doors to allow cooled contents inside itself to be taken outside the refrigerator without troubling in opening the right or left door of the refrigerator main body; and a dispenser 21.

A cooling air circulator including a compressor for compressing a coolant, a fan motor for circulating the cooling air and a damper for controlling a temperature of the home bar is not shown in FIG. 1 or FIG. 2.

Referring to such a refrigerator of which doors are installed at both right side and left side of the refrigerator main body 10 (termed as 'SXS refrigerator', hereinafter), a user may store in and take out contents such as beer or cans from the home bar 31 provided thereto, without troubling in opening the doors 20 and 30 of the main body of the refrigerator.

However, as to the conventional SXS refrigerator having the home bar, in case that contents are loaded into the home bar by simply opening the door thereof without opening the left or right door 20 and 30 of the main body of the SXS refrigerator, since the refrigerator itself is not able to judge whether the contents were loaded in the home bar, time to be taken for cooling the contents would be lengthened and their freshness is not satisfying.

SUMMARY OF THE INVENTION

Therefore, an object of the present invention is to provide an apparatus operated in response to a load in a home bar of a refrigerator which is capable of judging the amount of a load inputted to a home bar by using both a temperature sensor of the home bar and that of the refrigerator so as to cut down on a time taken for cooling the load, thereby maintaining a freshness of the load and serving the convenience of users, and to its method.

To achieve these and other advantages and in accordance with the purposed of the present invention, as embodied and broadly described herein, there is provided an apparatus operated in response to a load in a home bar of a SXS refrigerator having the home bar at one side of its door and a cooling air circulator including: a refrigerating chamber temperature sensor for sensing a temperature change of a refrigerating chamber; a home bar temperature sensor for sensing a temperature change of the home bar; and a microprocessor for comparing a temperature change amount of the home bar sensed by the home bar temperature sensor and the temperature change amount of the refrigerating chamber sensed by the refrigerating chamber temperature sensor after a load is inputted to the home bar, and setting a temperature of the refrigerating chamber at a lower degree in accordance with the comparison result and accordingly driving a cooling air circulator.

To attain the above object, there is also provided an operating method in response to a load in a home bar of a SXS refrigerator, comprising the steps of: measuring temperatures of a home bar and a refrigerating chamber by sensing opening and closing of a door of the refrigerator; measuring again temperatures of the home bar and the refrigerating chamber after a predetermined time lapses and comparing them with the previously measured temperatures; and judging whether a load was inputted to the home bar and controlling the cooling air circulator according to the result of the judgement so as to cool the load in the home bar.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE PREFERRED EMBODIMENTS

Reference will now be made in detail to the preferred embodiments of the present invention, examples of which are illustrated in the accompanying drawings.

The apparatus operated in response to a load in a home bar of a SXS refrigerator and its operating method will now be described with reference to the accompanying drawings.

Figure 1:
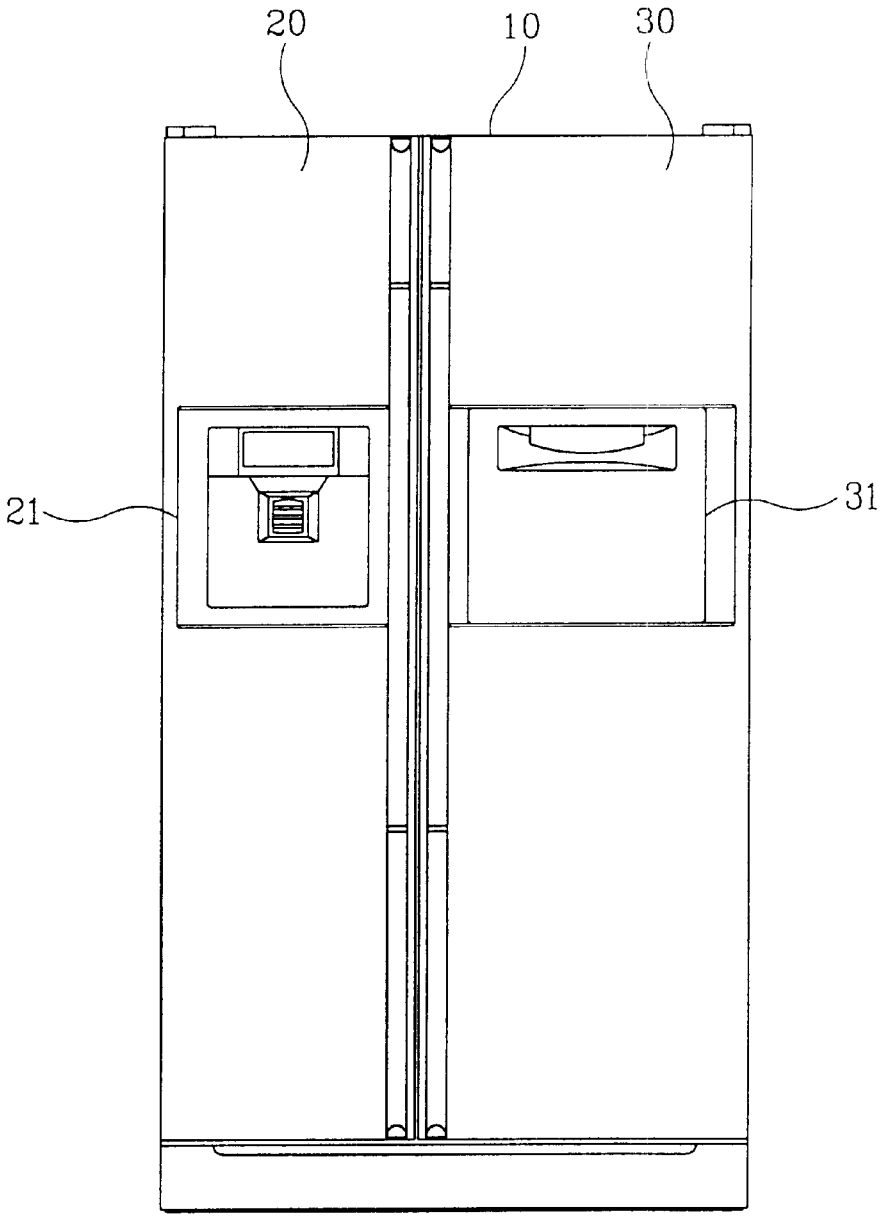
FIG. 1 Prior Art
FIG. 1 illustrates an SXS refrigerator with its door closed in accordance with a conventional art.
Figure 2:
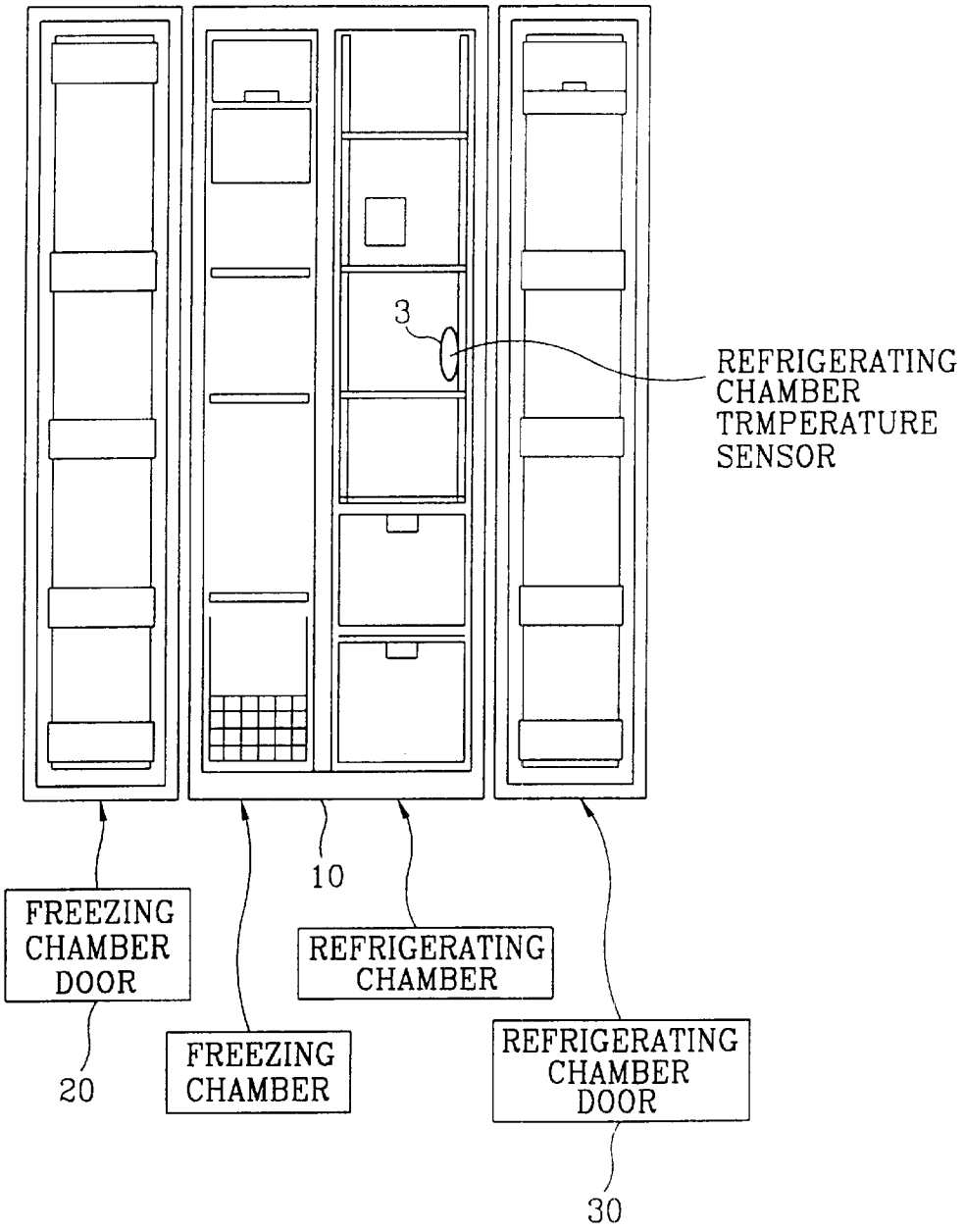
FIG. 2 Prior Art
FIG. 2 illustrates an SXS refrigerator with its door opened in accordance with the conventional art.
Figure 3:
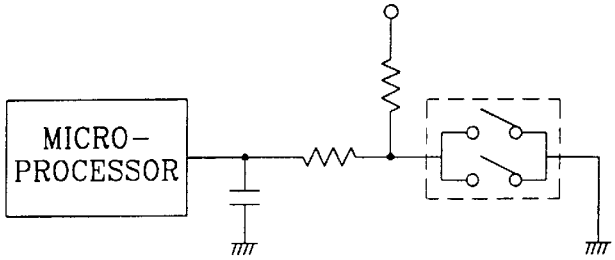
FIG. 3 Prior Art
FIG. 3 is an exemplary view of a door opening/closing sensing unit in accordance with the conventional art.
Figure 4:
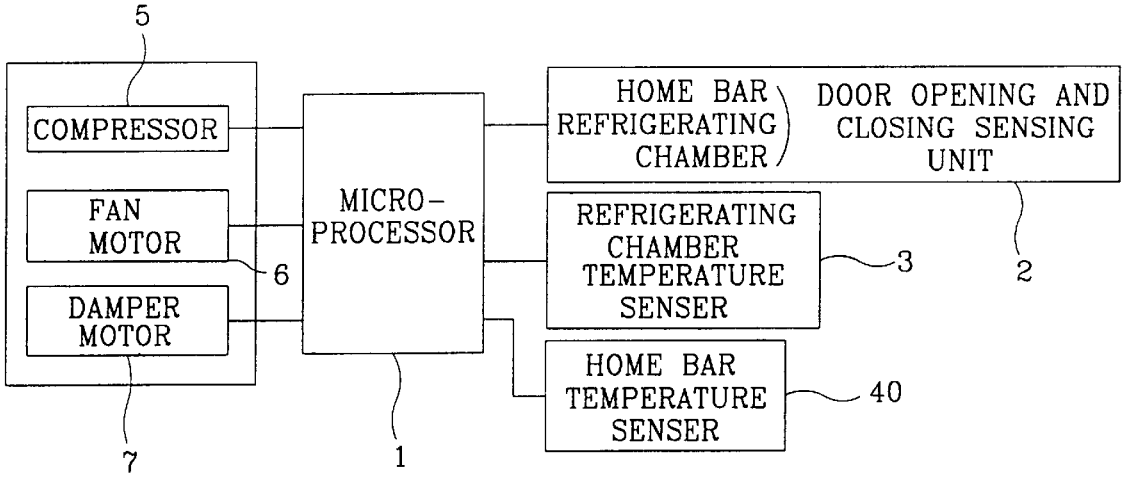
FIG. 4 is a schematic view of a microprocessor performing an operation in response to a load, each sensor and a cooling air circulator in accordance with the present invention.
Figure 5:
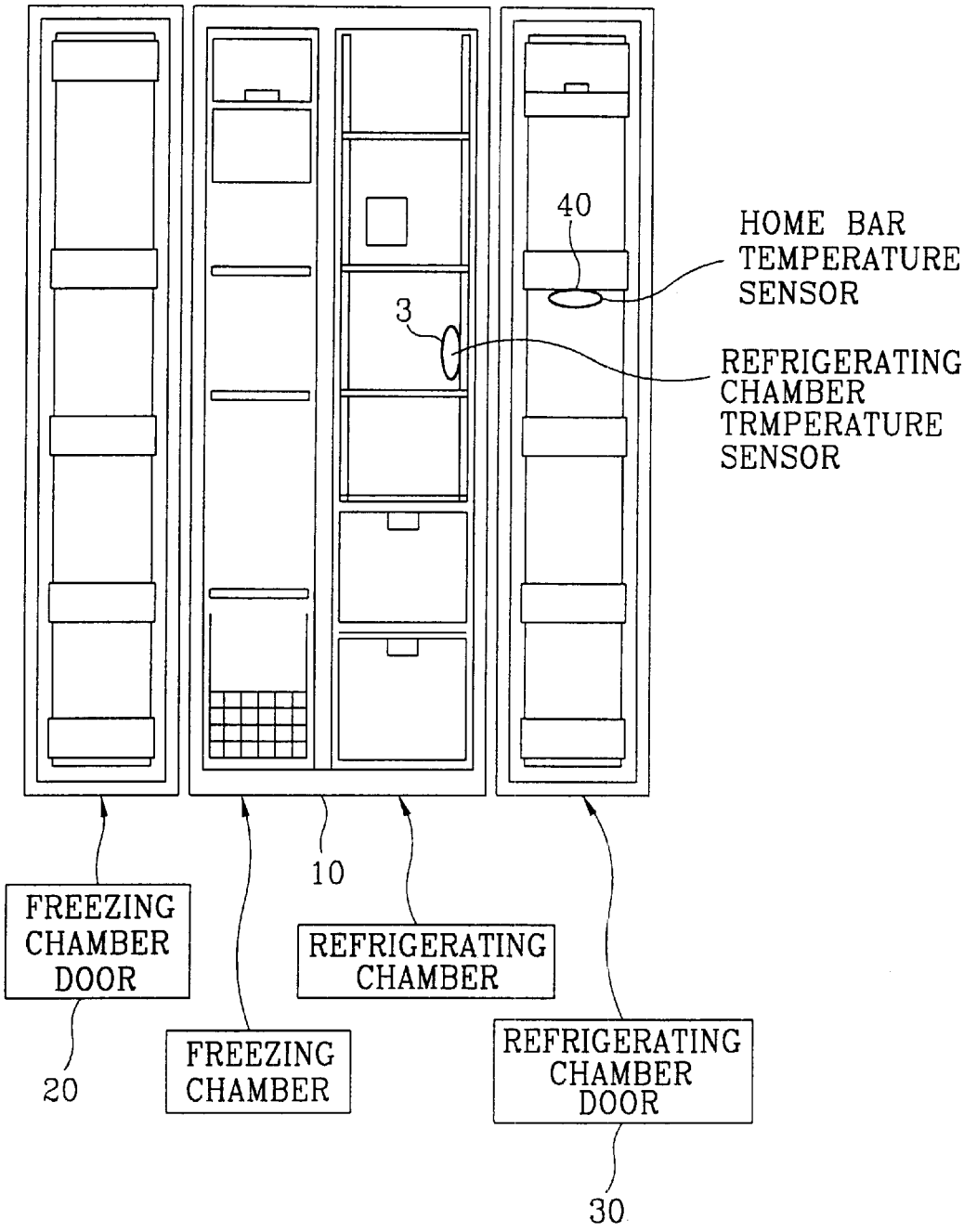
FIG. 5 shows an SXS refrigerator in accordance with the present invention.

FIG. 3 is an exemplary view of a door opening/closing sensing unit in accordance with the conventional art; FIG. 4 is a schematic view of a microprocessor performing an operation in response to a load, each sensor and a cooling air circulator in accordance with the present invention; and FIG. 5 shows an SXS refrigerator in accordance with the present invention.

The apparatus operated in response to a load in a home bar of a SXS refrigerator includes: a refrigerator main body 10 consisting of a freezing chamber and a refrigerating chamber at its inner side; a left door 20 and a right door 30 each rotatably installed at both sides of the refrigerator main body 10 of the refrigerator so as to open and close the main body; a home bar 31 insertedly installed at either side of the left and right doors to allow cooled contents of itself to be taken outside the refrigerator without troubling in opening the right and left doors of the refrigerator main body 10; a home bar temperature sensor 40 for sensing a temperature of the home bar 31; a refrigerating chamber temperature sensor 3 for sensing a temperature of the refrigerating chamber; cooling air circulators 5, 6 and 7 for circulating a cooling air to cool contents inside the refrigerator; a door opening and shutting sensing unit 2 for sensing the opening and closing of the left and right doors of the refrigerator main body as well as opening and closing of door of the home bar; and a microprocessor 1 for driving the cooling air circulators 5, 6 and 7 upon receipt of a signal from the door opening and closing sensing unit 2 and from the temperature sensors 3 and 40.

The operation of the apparatus according to the present invention is performed in response to a load in a home bar by using the fact that a temperature change of the home bar is higher compared to that of the refrigerating chamber, in case that the load is inputted to the home bar.

When a door of the refrigerating chamber or that of the home bar is opened, which is sensed by the door opening and closing sensing unit 2. The temperature of the refrigerating chamber just before the door is opened (referred to as 'R1', hereinafter) and the temperature of the home bar just before the door is opened are respectively sensed by the refrigerating chamber temperature sensor 3 and the home bar temperature sensor 40 and stored in the microprocessor 1.

The door opening and dosing sensing unit 2 can be simply realized as shown in FIG. 3.

When a load is inputted to the home bar and its door is closed, a first time T1 and a second time T2 are counted. The first time T1 refers to a reference time for starting an operation in response to the load, while the second time T2 refers to a reference time for releasing the operation in response to the load.

As a predetermined time T1 lapses after the load is inputted to the home bar and its door is closed, the temperature of the home bar (referred to as 'RH1', hereinafter) rises due to the inputted load thereto and the temperature of the refrigerating chamber (referred to as 'R2', hereinafter) falls owing to the circulation of a cooling air.

In the present invention, the judgement for the fact that a load is much inputted to the home bar is made on the basis of the fact that the temperature of the home bar becomes higher by more than a predetermined value (i.e., more than +1.0° C.) compared to the temperature just before the door is opened after a load is inputted to the home bar and a predetermined time T1 lapses and the temperature of the refrigerating chamber falls by more than a predetermined value (i.e., more than 0.5° C.) compared to the temperature just before the door is opened after a predetermined time T1 lapses, and based on the judgement, the operation in response to the load is started.

When the operation in response to the load is started, a pre-set target temperature (referred to as '$C_R$', hereinafter) of the refrigerating chamber is lowered down by more than a predetermined value (i.e., +1° C.) so as to be reset as a new target temperature, according to which the cooling air circulators 5, 6 and 7 are operated to cool the load inputted in the home bar.

Such an operation in response to the load is not released until a predetermined condition is satisfied, and the operation of the refrigerator returns to its normal operation.

In this respect, the condition for releasing the operation in response to the load is as follows: when the maximum operation time T2 as pre-set for the operation in response to the load lapses, or when the temperature of the home bar reaches the same level as or becomes lower than the temperature just before the door is opened according to the result of the operation in response to the load, the operation in response to the load is released and it returns to the normal operation.

Referring to the microprocessor 1, as shown in FIG. 4, it drives the cooling air circulators 5, 6 and 7 upon receipt of output signals from the door opening and closing sensing unit 2, the refrigerating chamber temperature sensor 3 and the home bar temperature sensor 40, according to which the operation in response to the load is performed.

Operating method in response to the load in the home bar of the refrigerator in accordance with the present invention will now be explained with reference to FIG. 6.

Figure 6:
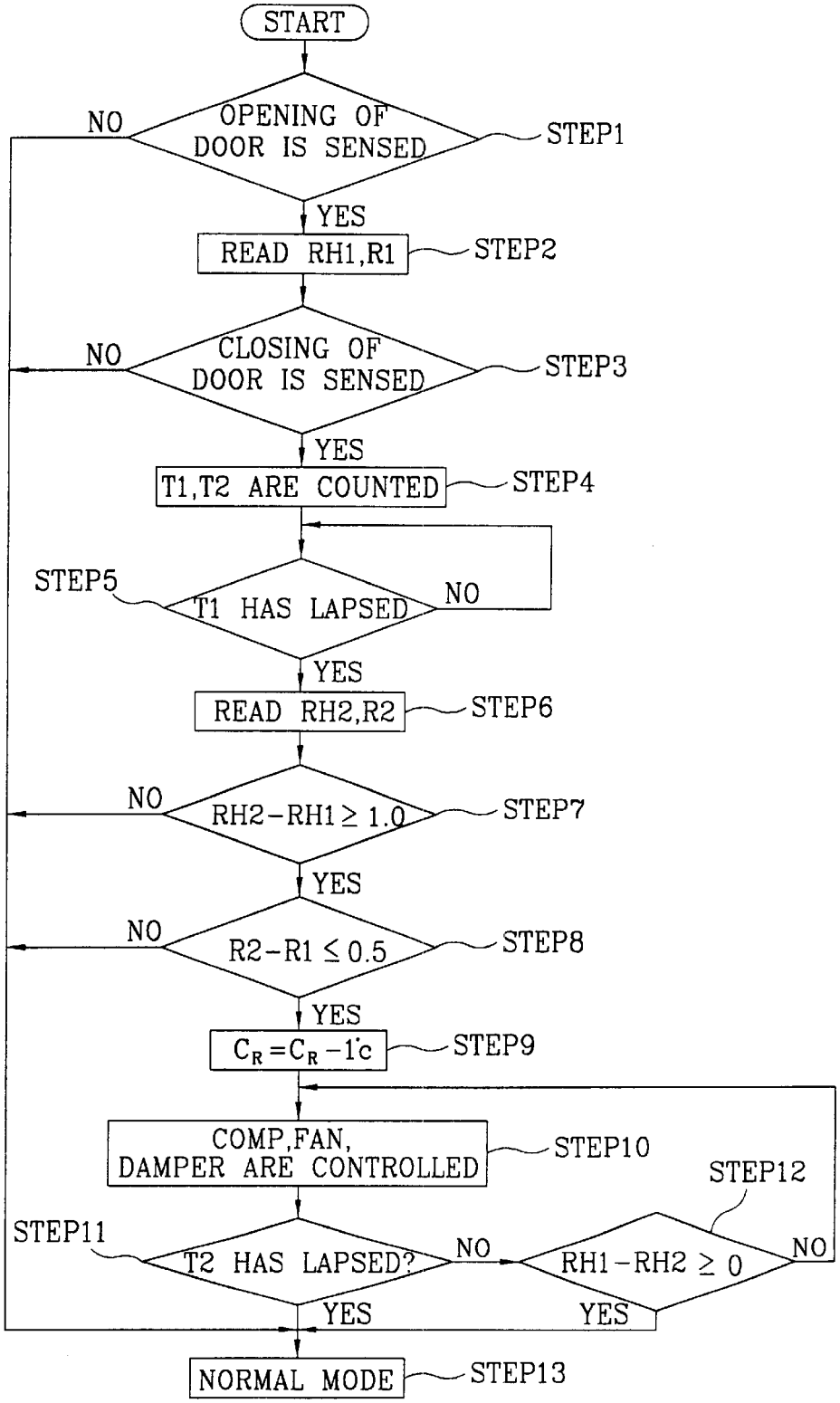
FIG. 6 is a flow chart of the operating method in response to a load in accordance with the present invention.

FIG. 6 is a flow chart of the operating method in response to a load of in a home bar of a refrigerator in accordance with the present invention.

As shown in the drawing, the operating method in response to the load in the home bar of the refrigerator includes the steps of: sensing whether a door of a refrigerating chamber or a door of the home bar was opened in a step S1; performing a normal operation in case that the door was not opened according to the result of the sensing, or storing a temperature RH1 sensed by the home bar temperature sensor 40 and the temperature R1 sensed by the refrigerating chamber temperature sensor 3, both temperatures sensed just before the door was opened in the microprocessor 1, in case that the door was opened according to the result of the sensing in a step S2; sensing closing of the door in a step S3; performing a normal operation in case that the door was not closed according to result of the sensing, or counting a first time T1 and a second time T2 in case that the door was closed according to the result of the sensing in a step S4; judging whether the first time T1 has lapsed in a step S5; sensing RH2 and R2 respectively by means of the home bar temperature sensor 40 and the refrigerating temperature sensor 3 in case that the first time T1 has lapsed according to the result of the judgement in a step S6; comparing RH1 and RH2 as stored in the step S2 to judge that RH2 is greater than RH1 by more than a predetermined value (i.e., more than 1.0° C.) in a step S7; comparing RI as stored in the step S2 and R2 as stored in the step S6 to judge whether the R2 falls lower than R1 by more than a predetermined value (i.e., more than 0.5° C.) (R2−R1<=0.5° C.) in case that the RH2 is greater than RH1 by more than the predetermined value according to the judgement in the step S7 in a step S8; varying the pre-set target temperature CR of the refrigerating chamber to a lower degree (i.e., $C_R$=$C_R$−1° C.) in case that R2 fell by more than a predetermined value (i.e., 0.5° C.) compared to the RI according to the judgement in the step S8 in a step S9; operating the compressor to be turned on or turned off so that the temperature of the refrigerating chamber reaches the varied target temperature ($C_R$−1° C.) and operating the fan motor along with the damper in a step S10; judging whether the second time T2 has lapsed in a step S11; judging whether RH2 is lower than or the same as RH1 (RH1−RH2≧0) in case that the second time T2 has not lapsed according to the judgement in the step S11 in a step S12; operating in a normal mode in case that RH2 is the same as or lower than RH1 according to the judgement in the step S12, or otherwise, repeatedly performing the step 10 or the step 12 in a step S13.

In case that the door of the refrigerating chamber or the door of the home bar is opened to input a load, the opening of the door is sensed so that the temperature R1 of the refrigerating chamber and the temperature RH1 of the home bar just before the door is opened are sensed and stored in the microprocessor 1 in the steps S1 and S2.

When the load is inputted to the home bar and then closing of the door is sensed, the time T1, the reference time for starting the operation in response to the load, and the time T2, one of the conditions for releasing the operation in response to the load, are started to be counted in the steps S3 and S4.

When the time T1 has lapsed, the temperature R2 of the refrigerating chamber and the temperature RH2 of the home bar at the time when the T1 lapses are sensed and compared to R1 and RH1 in the steps S5 and S6.

The operation in response to the load is performed when a load is inputted to the home bar by using the fact that the temperature change of the home bar is greater than that of the refrigerating chamber.

That is, the operation in response to the load is started to be performed according to the judgement that a load was inputted to the home bar by sensing that the temperature of the home bar becomes higher by more than a predetermined value (i.e., +1° C.) compared to the temperature before the door was opened and the temperature of the refrigerating chamber becomes lowered down by more than a predetermined value (i.e., +0.5° C.) compared to the temperature before the door was opened in the steps S7 and S8.

For performing the operation in response to the load, the target temperature value CR of the refrigerating chamber is reset (i.e., $C_R$=$C_R$−1° C.) by being lowered down by more than a predetermined value (i.e., +1.0° C.) compared to the pre-set value, according to which the cooling air circulators are driven in the steps S9 and S10.

The operation in response to the load is released when the temperature of the home bar is lowered down and reaches a temperature just before the door was opened, or when a predetermined time T2 has lapsed in the steps S11 and S12.

And, when the operation in response to the load is ended, it returns to the normal operation mode in the step S13.

As so far described, according to the operating method in response to a load in the home bar of the refrigerator of the present invention, in case that a load is inputted to the home bar by opening the door of the home bar or the door of the refrigerating chamber, depending on the fact that the temperature of the home bar goes up due to the inputted load and the temperature of the refrigerating chamber goes down with no load inputted, the pre-set target temperature of the refrigerating chamber is reset to be lowered down, so as to cool the load inputted to the home bar promptly, thereby maintaining freshness of the load and serving the convenience of users.

As the present invention may be embodied in several forms without departing from the spirit or essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall within the meets and bounds of the claims, or equivalence of such meets and bounds are therefore intended to be embraced by the appended claims.

What is claimed is:

1. An operating method in response to a load in a home bar of a SXS refrigerator comprising:

a first step for sensing a temperature of a home bar and that of a refrigerating chamber, storing it in a microprocessor and sensing closing of a door of a home bar or that of the refrigerating chamber, in case that the door of the home bar or that of the refrigerating chamber was opened;

a second step for counting predetermined times T1 and T2 after either door is closed, sensing temperatures of the refrigerating chamber and of the home bar after the predetermined time T1 has lapsed, and storing it in the microprocessor;

a third step for comparing the temperature of the home bar as sensed in the first step and the temperature of the home bar as sensed in the second step;

a fourth step for comparing the temperature of the refrigerating chamber as sensed in the first step and the temperature of the refrigerating chamber as sensed in the second step according to the comparison result; and a fifth step for setting the temperature of the refrigerating chamber to a lower level according to the comparison result and performing an operation in response to the load in the home bar; and releasing the operation in response to the load in the home bar when the predetermined time T2 lapses or the temperature of the home bar becomes lower than the temperature of the home bar as sensed in the first step.

2. The operating method according to claim 1, wherein the first step includes a sub-step for performing a normal operation in case that opening of the door or closing of the door is not sensed.

3. The operating method according to claim 1, wherein, in the third step, in case that the temperature of the home bar sensed in the first step is higher than that of the home bar sensed in the second step by more than a predetermined value, the fourth step is carried out, or otherwise, a normal operation is performed.

4. The operating method according to claim 1, wherein, in the fourth step, in case that the temperature of the refrigerator sensed in the first step is lower than that of the refrigerating chamber sensed in the second step by more than a predetermined value, the fifth step is carried out, or otherwise, a normal operation is performed.

* * * * *